US008990995B2

(12) United States Patent
Jimenez et al.

(10) Patent No.: US 8,990,995 B2
(45) Date of Patent: Mar. 31, 2015

(54) ORAL CARE IMPLEMENT HAVING A BODY DISPOSED WITHIN THE HANDLE

(75) Inventors: Eduardo Jimenez, Manalapan, NJ (US); Michael Rooney, Millburn, NJ (US); Robert Moskovich, East Brunswick, NJ (US); Jacob Pringiers, Colombo (LK); Luca Casini, Milan (IT)

(73) Assignee: Colgate-Palmolive Company, New York, NY (US)

( * ) Notice: Subject to any disclaimer, the term of this patent is extended or adjusted under 35 U.S.C. 154(b) by 298 days.

(21) Appl. No.: 13/516,996

(22) PCT Filed: Dec. 18, 2009

(86) PCT No.: PCT/US2009/068638

§ 371 (c)(1),
(2), (4) Date: Jun. 18, 2012

(87) PCT Pub. No.: WO2011/075132

PCT Pub. Date: Jun. 23, 2011

(65) Prior Publication Data

US 2012/0255136 A1 Oct. 11, 2012

(51) Int. Cl.

| | |
|---|---|
| ***A46B 9/04*** | (2006.01) |
| ***A46B 5/02*** | (2006.01) |
| ***A46B 15/00*** | (2006.01) |

(52) U.S. Cl.

CPC . *A46B 5/02* (2013.01); *A46B 5/026* (2013.01); *A46B 15/0087* (2013.01); *A46B 2200/1066* (2013.01)

USPC ..... 15/167.1; 15/143.1

(58) Field of Classification Search

CPC ..... B25G 1/10; B25G 1/102; B25G 1/105; A46B 9/04; A46B 5/021

USPC ..... 15/143.1, 167.1; 16/DIG. 19, 431, 436

See application file for complete search history.

(56) References Cited

U.S. PATENT DOCUMENTS

| | | | |
|---|---|---|---|
| 759,490 | A | 5/1904 | Yates |
| 5,398,369 | A | 3/1995 | Heinzelman et al. |
| 6,138,315 | A | 10/2000 | Schmitt et al. |
| 6,353,958 | B2 | 3/2002 | Weihrauch |
| 6,601,272 | B2 | 8/2003 | Stvartak et al. |
| 6,662,406 | B2 | 12/2003 | Shonfeld et al. |

(Continued)

FOREIGN PATENT DOCUMENTS

| | | |
|---|---|---|
| DE | 102006005616 | 8/2007 |
| EP | 1211962 | 6/2002 |

(Continued)

OTHER PUBLICATIONS

International Search Report and Written Opinion in International Application No. PCT/US09/068638, mailed Jun. 1, 2010.

*Primary Examiner* — Laura C Guidotti
(74) *Attorney, Agent, or Firm* — Ryan M. Flandro

(57) ABSTRACT

An oral care implement having a body that appears to float within an aperture of the handle. The body can perform both a decorative and/or utilitarian function depending on its design and/or location on the handle. In one aspect, the invention can be an oral care implement comprising: a handle; a head connected to the handle; an aperture in the handle; and a grip body disposed within the aperture and enveloping a body, the grip body constructed of a first material and the body constructed of a second material, the second material being harder than the first material.

29 Claims, 9 Drawing Sheets

(56) References Cited

U.S. PATENT DOCUMENTS

| | | | | |
|---|---|---|---|---|
| 6,687,940 | B1 | 2/2004 | Gross et al. | |
| 6,972,106 | B2 | 12/2005 | Huber et al. | |
| 7,047,591 | B2 | 5/2006 | Hohlbein | |
| 7,165,556 | B2 | 1/2007 | Gilbert et al. | |
| 7,383,619 | B2 * | 6/2008 | Gross et al. | 16/430 |
| 7,458,125 | B2 | 12/2008 | Hohlbein et al. | |
| 8,448,284 | B2 * | 5/2013 | Gross et al. | 15/143.1 |
| 8,549,691 | B2 * | 10/2013 | Moskovich et al. | 15/143.1 |
| 2005/0109364 | A1 | 5/2005 | Gross et al. | |
| 2007/0186453 | A1 | 8/2007 | Little et al. | |
| 2010/0101037 | A1 | 4/2010 | Gross et al. | |
| 2010/0263149 | A1 * | 10/2010 | Ballmaier et al. | 15/167.1 |

FOREIGN PATENT DOCUMENTS

| | | |
|---|---|---|
| WO | WO 2004/026162 | 4/2004 |
| WO | WO 2007/003387 | 1/2007 |
| WO | WO 2007/106757 | 9/2007 |

* cited by examiner

ORAL CARE IMPLEMENT HAVING A BODY DISPOSED WITHIN THE HANDLE

This application is a national stage entry under 35 U.S.C. §371 of International Patent Application No. PCT/US2009/068638, filed 18 Dec. 2009, the contents of which are incorporated herein by reference.

FIELD OF THE INVENTION

The present invention relates generally to oral care implements, and specifically to a handle of an oral care implement, such as toothbrushes, that comprises a body that appears to float within an aperture of the handle. The body can serve both a decorative and/or utilitarian function.

BACKGROUND OF THE INVENTION

Oral care implements, especially toothbrushes, are used by many people on a daily basis. Typical oral care implements comprise an elongated handle and a head connected to one end of the handle. The handle provides the structure by which the user grips and manipulates the oral care implement during use. The head typically comprises one or more elements designed to perform the intended function, such as teeth cleaning elements, soft tissues cleansers, and/or oral care agents.

Over the years, substantial efforts have been expended in improving the design of the handles of oral care implements for increased control, reduced damage to the oral surfaces, improved reach, and aesthetic desirability. Such efforts have included the development of handles having multiple components, including a hard core structure and soft gripping covers and grip bodies. Other existing handles have sections oriented at different angles relative to one another and the head.

Furthermore, the art has also recognized that it can often be difficult to convince a child to brush his/her teeth willingly. Thus, efforts have been made to create handles that include ornamental features that increase the desirability of children to use the oral care implement. Such efforts include molding the handle into a desired shape or character, providing aesthetically pleasing covers, providing toys within the handle, and/or incorporating electronically interactive devices within the handle.

Despite these efforts, a need still exists for an oral care implement that has a handle that provides greater design flexibility, creates an improved aesthetic appearance, affords improved control and/or reach, reduces damage to the oral surface, and/or improves the experience of an oral care session.

SUMMARY OF THE INVENTION

In one aspect, the invention can be an oral care implement comprising: a handle having a longitudinal axis, a first surface, and a second surface opposite the first surface; a head connected to the handle; an aperture forming a passageway through the handle from the first surface to the second surface; a bulbous body positioned within the aperture; and at least one strut extending from the sidewall of the aperture, the bulbous body connected to a distal end of the strut so that the bulbous body is supported within the aperture so as to be spaced from the sidewall of the aperture by an annular gap.

In another aspect, the invention can be an oral care implement comprising: a handle having a longitudinal axis, a first surface and a second surface opposite the first surface; a head connected to the handle; an aperture forming a passageway through the handle from the first surface to the second surface; a body positioned within the aperture, the body constructed of a hard material and supported within the aperture so as to be spaced from the sidewall of the aperture; an elastomeric grip body disposed within the aperture and enveloping the body; and wherein the body is visible through the elastomeric grip body.

In yet another aspect, the invention can be an oral care implement comprising: a handle having a longitudinal axis, a first surface and a second surface opposite the first surface; a head connected to the handle; an aperture forming a passageway through the handle from the first surface to the second surface; and an elastomeric grip body disposed within the aperture and enveloping a solid body.

In still another aspect, the invention can be an oral care implement comprising: a handle; a head connected to the handle; an aperture in the handle; and a grip body disposed within the aperture and enveloping a body, the grip body constructed of a first material and the body constructed of a second material, the second material being harder than the first material.

In a further aspect, the invention can be any ansate implement comprising any one of the inventive handles described above.

BRIEF DESCRIPTION OF THE DRAWINGS

This invention is capable of use in a broad array of oral care implements and hygiene products. The drawings illustrate one use of the invention and are not to be construed as the only embodiment of the invention.

DETAILED DESCRIPTION OF THE INVENTION

Figure 1:
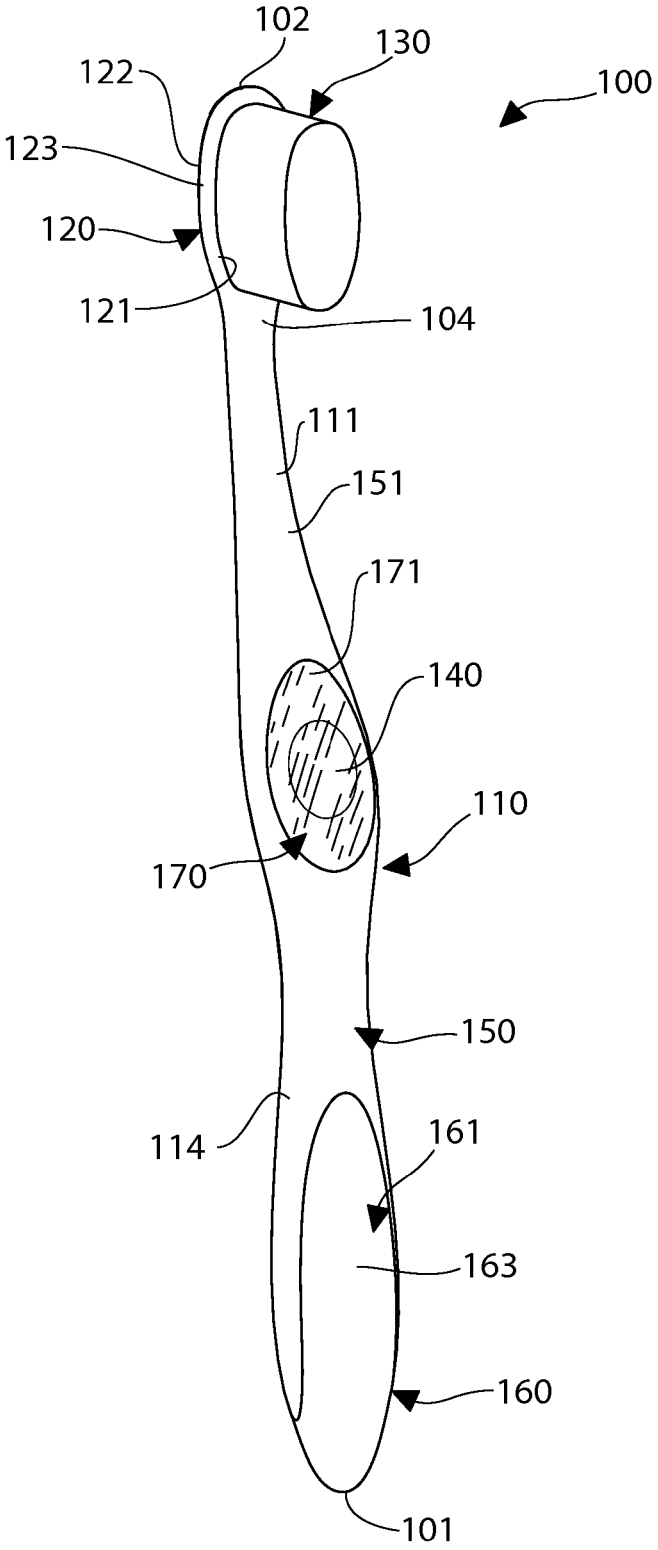
FIG. 1 is a perspective front view of a toothbrush according to one embodiment of the present invention.

In the following description, the invention is discussed in terms of a manual toothbrush having the inventive handle. However, in other forms, the invention could be in the form of other oral care implements including a soft-tissue cleansing implement, an inter-proximal pick, a flossing tool, a plaque scraper, a powered toothbrush, or other ansate implement designed for oral care. It is also to be understood that other embodiments may be utilized, and that structural and functional modifications may be made without departing from the scope of the present invention.

Referring first to FIGS. 1-4 concurrently, a toothbrush 100 is illustrated according to one embodiment of the present invention. The toothbrush 100 generally comprises a handle 110 and a head 120. The handle 110 provides the user with a mechanism by which he/she can readily grip and manipulate the toothbrush 100. The handle 110 includes ergonomic features which provide a high degree of control for the user while maintaining comfort. The head 120 is connected to a distal end 104 of the handle 110 and includes a set of teeth cleaning elements 130, which are generically illustrated.

Figure 2:
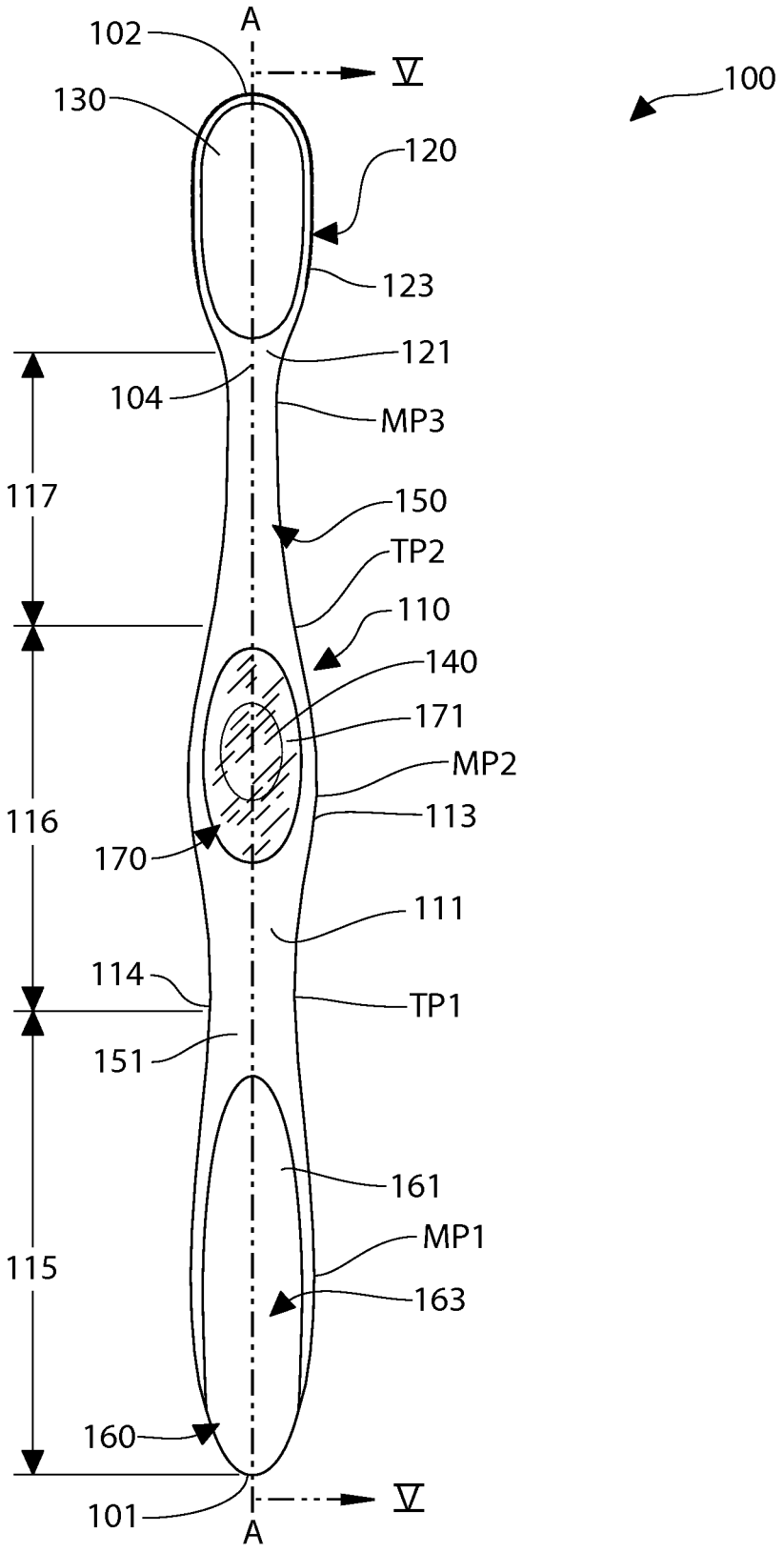
FIG. 2 is a front view of the toothbrush of FIG. 1 according to one embodiment of the present invention.
Figure 4:
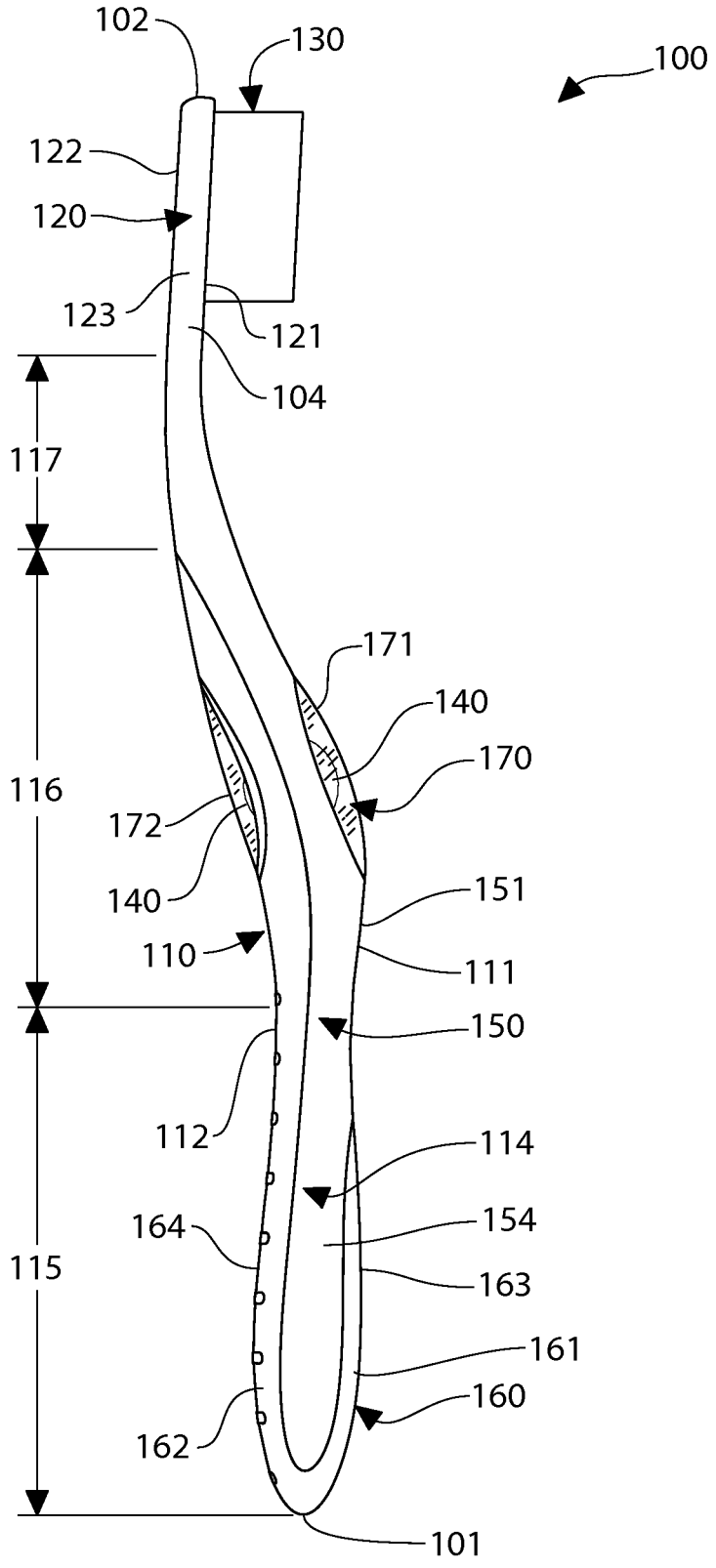
FIG. 4 is a left side view of the toothbrush of FIG. 1 according to one embodiment of the present invention, the right side view of which is a mirror image.

Generally, the toothbrush 100 extends from a proximal end 101 (which is also the proximal end of the handle 110) to a distal end 102 along a longitudinal axis A-A (illustrated in FIG. 2). Conceptually, the longitudinal axis A-A is a reference line that is generally coextensive with the three-dimensional center line of the handle 110 and the head 120. Because the handle 110 is a non-linear structure (as can be seen in FIG. 4 as viewed laterally) in the illustrated embodiment, the longitudinal axis A-A for toothbrush 100 is also non-linear in the illustrated embodiment. However, the invention is not so limited, and in certain embodiments, the toothbrush may have a simple linear arrangement and thus a substantially linear longitudinal axis A-A.

The head 120 is operably connected to the handle 110. As discussed in greater detail below, the head 110 and the handle 120 of the toothbrush 100 are preferably formed as an integral structure using an injection molding process. More specifically, in the exemplified embodiment, the head 120 is integrally formed with the elongated handle body 150 (discussed in greater detail below). However, in other embodiments, the handle 110 and the head 120 may be formed as separate components which are operably connected at a later stage of the manufacturing process by any suitable technique known in the art, including without limitation thermal welding, sonic welding, a tight-fit assembly, a coupling sleeve, adhesion, or fasteners. Whether the head 120 and the handle 110 are constructed as an integral piece or a multi-piece assembly (including connection techniques) is not limiting of the present invention in all embodiments. Furthermore, other manufacturing techniques may be used in place of and/or in addition to injection molding to create the handle 110 and/or the head 110 (or components thereof), such as milling and/or machining.

It should be noted that relative terms such as distal, middle, proximal, upper, lower, top, bottom, lateral, front, rear, left, right etc. are merely used to delineate relative positions of the components of the toothbrush 100 with respect to one another and are not intended to be in any further way limiting of the present invention.

The head 120 generally comprises a front surface 121 and a rear surface 122. The front surface 121 and the rear surface 122 of the head 120 can take on a wide variety of shapes and contours, none of which are limiting of the present invention. For example, the front and rear surfaces 121, 122 can be planar, contoured or combinations thereof. The front surface 121 and rear surface 122 are bound by a peripheral or lateral surface 123.

The set of teeth cleaning elements 130, which are generically illustrated as a block, are provided on and extend outward from the front surface 121 of the head 120 for cleaning contact with an oral surface, preferably teeth. While the set of cleaning elements 130 is particularly suited for brushing teeth, the set of cleaning elements 130 can also be used to clean oral soft tissue, such as a tongue, gums, or cheeks instead of or in addition to teeth. As used herein, the term "cleaning element" is used in a generic sense to refer to any structure that can be used to clean or massage an oral surface through relative surface contact.

Common examples of "cleaning elements" include, without limitation, filament bristles, fiber bristles, nylon bristles, spiral bristles, rubber bristles, elastomeric protrusions, flexible polymer protrusions, co-extruded filaments, flag bristles, crimped bristles, anti-bacterial bristles and combinations thereof and/or structures containing such materials or combinations.

The set of cleaning elements 130 can be connected to the head 120 in any manner known in the art. For example, anchor free tufting (AFT) could be used to mount the cleaning elements. In AFT, a plate or membrane is secured to the brush head such as by ultrasonic welding. The bristles (or other elastomeric elements) extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block. Staple technology may also be used.

Furthermore, if desired, the rear surface 122 may also comprise additional structures for oral cleaning, such as a soft tissue cleanser. Such soft tissue cleansers are typically constructed of a thermoplastic elastomer ("TPE") and include one or more projections, such as nubs and/or ridges, for engaging and massaging soft oral tissue, such as the tongue.

The handle 110 of the toothbrush 100 generally comprises a front surface 111 and a rear surface 112 which is opposite the front surface 111. The handle 110 also comprises a right lateral surface 113 and a left lateral surface 114 opposite the right lateral surface 113. As best visible in FIGS. 2 and 3, the front surface 111, the rear surface 112, the right lateral surface 113 and the left lateral surface 114 collectively form the outer surface of the handle 110, which has a generally elliptical lateral cross-sectional shape along its longitudinal length.

As will be described in greater detail below, the overall front surface 111 of the handle 110 is formed by the collective of the outer surface 163 of the front leg 161 of the grip cover 160, the front surface 171 of the grip body 170, and a portion of the front surface 151 of the elongated handle body 150. Similarly, the overall rear surface 112 of the handle 110 is formed by the collective of the outer surface 164 of the rear leg 162 of the grip cover 160, the rear surface 172 of the grip body 170, and a portion of the rear surface 152 of the elongated handle body 150. The overall right lateral surface 113 of the handle 110 is formed by the collective of the right lateral surface 153 of the elongated handle body 150 and portions of the outer surfaces 163, 164 of the front and rear legs 161, 162 of the grip cover 160. Similarly, the overall left lateral surface 114 of the handle 110 is formed by the collective of the left lateral surface 154 of the elongated handle body 150 and portions of the outer surfaces 163, 164 of the front and rear legs 161, 162 of the grip cover 160.

Figure 3:
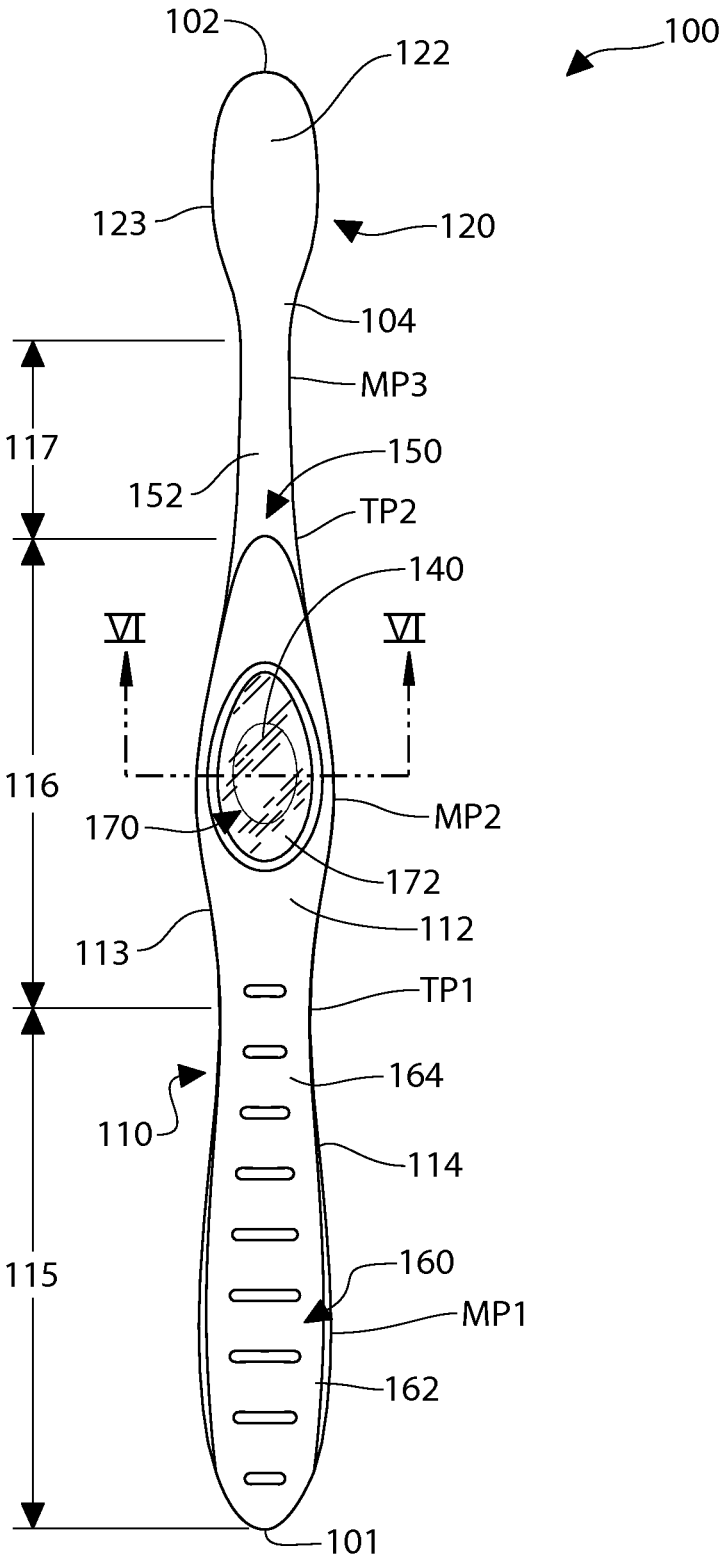
FIG. 3 is a rear view of the toothbrush of FIG. 1 according to one embodiment of the present invention.

As best shown in FIGS. 2-4, the handle 120 can be conceptually delineated in longitudinal sections comprising a proximal section 115, a middle section 116 and a neck section 117. The proximal section 115 is the portion or segment of the handle 110 that generally fits comfortably within the palm of the user. The middle section 116 forms the portion or segment of the handle 110 that generally fits comfortably between the user's thumb and index finger. The neck portion forms the portion or segment of the handle 110 that connects to the head 120.

The proximal section 115 longitudinally extends from the proximal end 101 of the toothbrush 100 to the middle section 116. The middle section 116 longitudinally extends from the proximal section 115 to the neck section 117. The neck section 117 extends from the middle section 116 to the head 120. While the head 120 is illustrated as being widened relative to the neck section 117 of the handle 110, the head 120 could in some constructions simply be a continuous extension or narrowing of the neck section 117 of the handle 110. The proximal section 115 comprises a transverse cross-sectional area that gradually increases from the proximal end 101 of the toothbrush 100 to a middle point MP1 of the proximal section 115. The transverse cross-sectional area of the proximal section 115 then gradually decreases from the middle point MP1 to the transition point TP1 between the proximal section 115 and the middle section 116. The middle section 116 has a transverse cross-sectional area that gradually increases from the transition point TP1 to the middle point MP2 of the middle section 116 and then gradually decreases from the middle point MP2 to the transition point TP2 between the middle section 116 and the neck section 117. The transverse cross-sectional area of the neck section 117 gradually decreases from the transition point TP2 to the middle point MP3 of the neck section and then increases from the middle point MP3 to the head 120. The handle 120 of the toothbrush 100 preferably has a maximum transverse cross-sectional area at either middle point MP1 of the proximal section 115 or at middle point MP2 of the middle section 116. The increasing and decreasing transverse cross-sectional area discussed above results in a handle 110 having an undulating structure which is more reliably and comfortably held within the user's hand. Further, this wide construction of the proximal and middle sections 115, 116 requires less fine motor control by the user and is, hence, easier to hold and manipulate. The term "middle point," in all instances, is not intended to be limited to a center point or a point equidistant from the referenced ends but may merely indicate a point between the referenced end delineations.

Referring solely to FIG. 4, the middle section 116 is angled with respect to the proximal section 115 and the neck section 117. Thought of another way, the middle section 116 is inclined relative to the proximal section and the neck section to define an inclined portion or segment of the handle 110 that is positioned for comfortable gripping and to facilitate a desired offset positioning of the head relative to the proximal section 115. The angle of the incline is preferably 23 degrees, but may range between 5 to 40 degrees. The inclined nature of the middle section 116 relative to the proximal and neck sections 115, 117 allows for improved control of the handle 110 during brushing in which the head 120 can be more desirably positioned within the mouth to engage the tooth cleaning elements 130 against the teeth.

The grip body 170 is located within the middle section 116 of the handle 110. The front leg 161 of the grip cover 160 covers a portion of the proximal section 115 of the handle 110 while the rear leg 162 of the grip cover 160 covers both the proximal section 115 and the middle section 116 of the handle 110.

Referring again to FIGS. 1-4 concurrently, a body 140 is located within and enveloped by the grip body 170. In the illustrated embodiment, the body 140 is a structural body having a bulbous ovoid shape that is embedded within the grip body 170 so that the body 140 is not exposed to the external atmosphere. The body 140 is preferably constructed of a different material than the grip body 170. More preferably, the body 140 is constructed of a material that is harder than the material of which the grip body 170 is constructed. Most preferably, the body 140 is constructed of a rigid material while the grip body 170 is constructed of an elastomeric material. Of course, different materials can be used.

The body 140 can be constructed of a hard plastic, such as polyethylene, polypropylene (PP), polyamide, polyester, cellulosics, SAN, acrylic, ABS or any other of the commonly known thermoplastics used in toothbrush manufacture. Preferably, the material selected for the body 140 is an opaque material. Utilizing an opaque material for the body 140 allows the body 140 to be is visible through the grip body 170. The body 140 can be a solid structure or a hollow structure. If the body 140 is hollow, the body will preferably comprise an outer shell constructed of a hard plastic, such as PP, and include an enclosed cavity that can be left empty or provided with a fluid or decorative items. Moreover, the body 140 can take on other shapes and dimensions.

The grip body 170 can be constructed of a resilient material, such as a soft thermoplastic elastomer (TPE). To provide optimum comfort as well as control benefits, the resilient materials of the grip body 170 preferably has a hardness durometer in a range of A11 to A15 Shore hardness. Of course, materials outside this hardness range could also be used. As an example, one preferred elastomeric material for the grip body 170 is styrene-ethylene/butylene-styrene (SEBS) manufactured by GLS Corporation. Nevertheless, other manufacturers can supply the SEBS material and other materials could be used. Preferably, the selected material for the grip body 170 is a transparent or translucent material so that the body 140 remains visible through the grip body 170. Most preferably, the grip body 170 is made of a translucent material. By making the grip body 170 out of a translucent material (rather than a transparent material), the top and bottom surface portions of the body 140 remain visible to the user through the grip body 170 while the struts 145 that support the body 140 within the aperture 155 (discussed in grater detail below with reference to FIGS. 5 and 6) are not visible to the user through the grip body 170. This gives the body 140 the appearance that it is floating within the grip body 170, when viewed by the user during normal use. As discussed below, the body 140 provides a structure that can be felt by the user through the grip body 170, thereby providing increased control of the toothbrush 100 during use. However, if desired, the body 140 can be designed to provide an ornamental and/or aesthetic function instead of or in addition to its utilitarian function.

Referring now to FIGS. 4 and 7-9, it can be seen that the handle 110 of the toothbrush 100 generally comprises four main components, which include the elongated handle body 150, the U-shaped grip cover 160, the grip body 170, and the body 140 (which in the illustrated embodiment is integrally formed as a unitary structure with the handle body 150). These components 140, 150, 160, 170 cooperatively form an ergonomic and cost effective handle 110 by which the user holds and manipulates the toothbrush. The structure of each of these components will now be described in detail.

Figure 7:
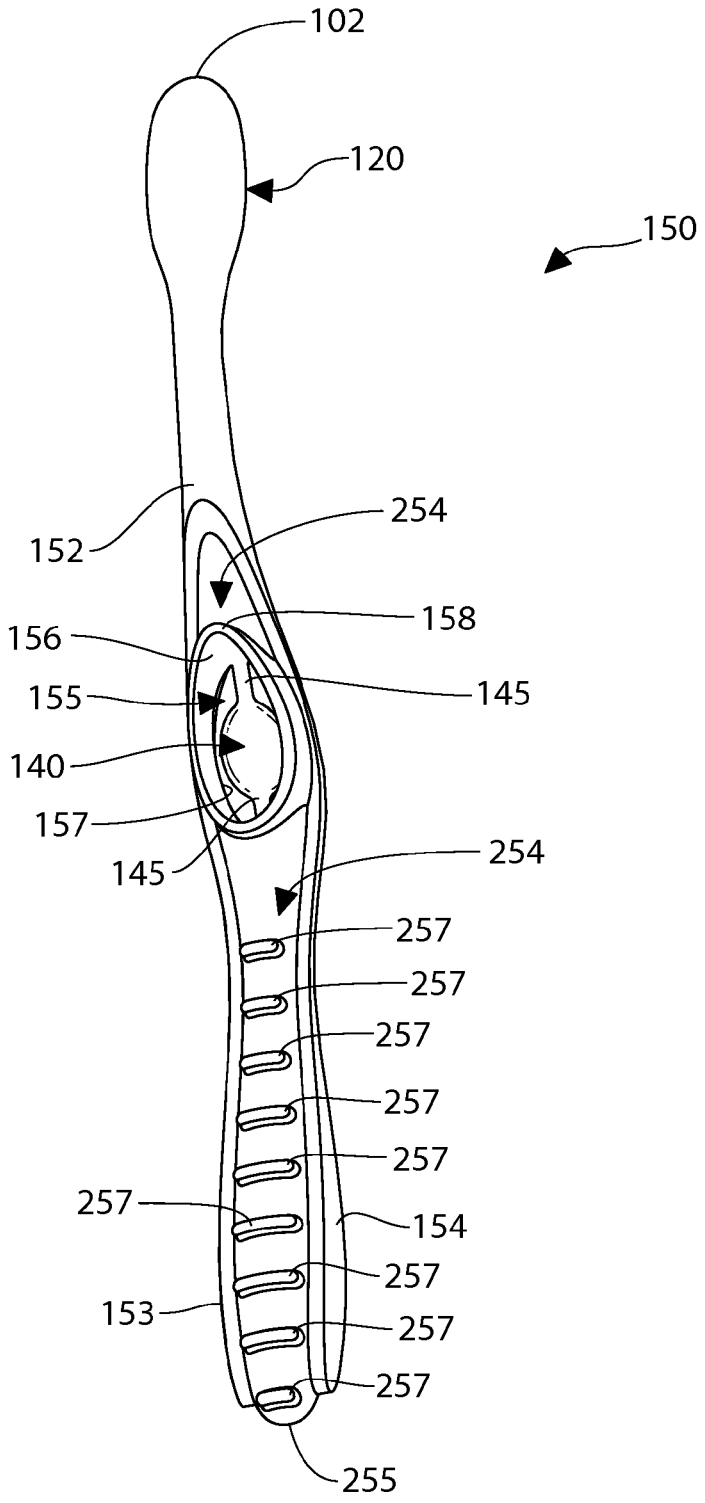
FIG. 7 is a rear perspective view of the main handle body of the toothbrush of FIG. 1 wherein the grip body and grip cover are removed.

Referring solely to FIG. 7, the elongated handle body 150 is preferably a unitary structure that integrally comprises the head 120 and provides the general structure and shape for the handle 110 of the toothbrush 100. The elongated handle body 150 comprises a front surface 151, a rear surface 152, a right lateral surface 153 and a left lateral surface 154. The rear surface 152 is opposite the front surface 151 while the right lateral surface 153 is opposite the left lateral surface 154.

Collectively, the surfaces 151-154 form the outer surface of the elongated handle body 150.

The elongated handle body 150 comprises an oval aperture 155 extending through the elongated handle body 150 from the front surface 151 to the rear surface 152. The aperture 155 forms a laterally oriented passageway through the elongated handle body 150 and is provided to house the body 140 and receive the grip body 170 (discussed in greater detail below). The aperture 155 preferably occupies more than fifty-percent (50%) of the transverse cross-sectional area of the handle 110 at middle point MP2, and more preferably occupies more than sixty-five percent (65%) of the transverse cross-sectional area of the handle 110 at middle point MP2. Nevertheless, other constructions are possible. The aperture 155 is located in the middle section 116 of the handle 110.

The aperture 155 is defined by a sidewall 156 that tapers with increasing depth from both the front and rear surfaces 151, 152 of the elongated handle body 150, thereby coming to an annular apex/edge 157 (FIG. 6) that is located within the aperture 155 and is the narrowest part of the aperture 155. This dual-tapered sidewall geometry may retain and allow dynamic positioning of the body 140 and/or the grip body 170 during use of the toothbrush 100. The sidewall 156 may, of course, have different geometries and shapes.

The sidewall 156 of the aperture 155 extends beyond the rear surface 152 of the elongated handle body 150, thereby forming an annular ridge (or rim) 158 that protrudes from the rear surface 152 of the elongated handle body 150. The annular ridge 158 circumferentially surrounds the aperture 155 on the rear surface 152 of the elongated handle body 150. In other embodiments, such an annular ridge can also be incorporated into the front surface 151 of the elongated handle body 150.

A longitudinally extending channel 254 (which can also be referred to as a groove or depression) is provided in the outer surface of the elongated handle body 150. The channel 254 is a U-shaped channel that starts on the front surface 151 of the elongated handle body 150, wraps around a proximal end 255 of the elongated handle body 150, and continues onto the rear surface 152 of the elongated handle body 150. More specifically, the channel 254 extends longitudinally from a point between the transition point TP2 and the proximal end 255 on the front surface 151 to the proximal end 255, wraps around the proximal end 255, and extends longitudinally from the proximal end 255 to the transition point TP2 on the rear surface 152. The channel 254 thereby extends along the proximal section 115 on the front surface 111 of the handle 110 and along the proximal and middle sections 115, 116 on the rear surface 112 of the handle 110. The channel 254 surrounds the aperture 155 on the rear surface 152 (specifically the annular ridge 158). As will be described in greater detail below, the channel 254 receives and is filled with the grip cover 160.

At least one outer ridge 257 is provided on the rear surface 152 of the elongated handle body 150. Preferably, a plurality of spaced apart outer ridges 257 are provided that protrude from the rear surface 152. While the outer ridges 257 could have virtually any shape, they are preferably in the form of spaced-apart ridges (or ribs) that laterally extend the width of the rear surface 152. The outer ridges 257 preferably span laterally between the lateral surfaces 113, 114 of the handle 110, although they may have different transverse lengths. The transverse length of each outer ridge 257 generally matches the width at the longitudinal location along the handle 110. However, the outer ridges 257 are preferably slightly short of the actual width of handle 110 at any one location so as to be covered on the sides by grip cover 160. Since outer ridges 257 span the width of the handle 110 in the proximal and middle sections 115, 116, they each have varying lengths due to the variations in the width of these sections 115, 116.

As a result of the spaced-apart arrangement of the outer ridges 257, a transverse channel or groove is defined between each of the adjacent arcuate outer ridges 257. These transverse channels are configured to receive and retain the material of the grip cover 160, such as a thermoplastic elastomer (TPE) or other similar materials used in oral care products.

The elongated handle body 150 is preferably a unitary single component constructed of a rigid material, such as for example a hard plastic. Suitable hard plastics include polyethylene, polypropylene (PP), polyamide, polyester, cellulosics, SAN, acrylic, ABS or any other of the commonly known thermoplastics used in toothbrush manufacture. Preferably, the elongated handle body 150 is constructed of a hard plastic material that is the same type of plastic as the hard plastic material of which the body 140 is constructed.

Referring still to FIG. 7, the body 140 is supported within the aperture 155 of the elongated handle body 150 by a pair of struts 145. The struts 145 are thin (relative to the body 140) beam structures that support the body 140 within the aperture 155 so that the body 140 is spaced from the sidewall 156. The struts 145 extend from the sidewall 156 of the aperture 155. The body 140 is connected to the distal ends of the struts 145 so that the body 140 is supported within the aperture 155 so as to be spaced from the sidewall 156 of the aperture 155 by an annular gap 300. This relation will be discussed in greater detail below with reference to FIGS. 5 and 6.

Most preferably, the elongated handle body 150, the body 140 and the struts 145 are formed as an integral single structure during a single injection molding process (multiple injection ports may be used). The two struts 145 are circumferentially spaced 180° apart on opposite sides of the body 145. The two struts 145 are substantially aligned and extend coaxially along the longitudinal axis A-A of the handle 110. While two struts 145 are illustrated as supporting the body 140, more or less struts can be used. Moreover, if desired, the struts 145, the elongated handle body 150 and the body 140 can be constructed of different material and/or as separate components.

Figure 8:
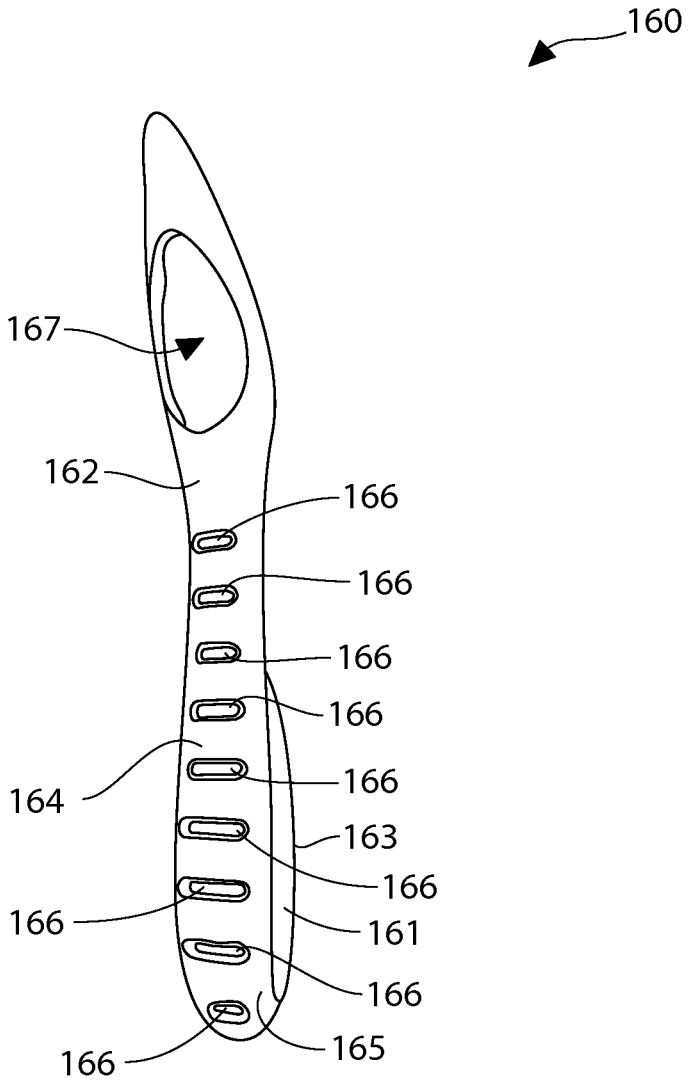
FIG. 8 is a perspective view of the grip cover of the toothbrush of FIG. 1 removed from the handle according to one embodiment of the present invention.

Referring now to FIG. 8, the grip cover 160 is a generally U-shaped (or tong-shaped) cover or layer of resilient material. The grip cover 160 is fixed to the elongated handle body 150 to provide a gripping surface to improve performance during use. The grip cover 160 is positioned within the channel 254 of the elongated handle body 150 when the toothbrush 100 is in an assembled state.

The grip cover 160 conceptually comprises three sections, a front leg 161, a rear leg 162 and a curved segment 165 that connects the front and rear legs 161, 162 in an opposing manner. The overall shape and size of the front and rear legs 161, 162 can be the same or different. In the illustrated embodiment, the rear leg 162 is substantially longer than the front leg 161. However, the legs 161, 162 can be mirror images of one another and, thus, be equal in length, width and overall shape and size in other embodiments. An opening 167 is provided in the rear leg 162. The opening 167 receives the annular ridge/rim 158 of the elongated handle body 150 when the grip cover 160 is fixed to the elongated handle body 150.

The rear leg 162 comprises a plurality of spaced-apart openings 166, preferably in the form of slots that extend transversely across the rear leg 162. The openings 166 are sized, shaped and positioned to be aligned with the outer ridges 257 of the elongated handle body 150. When the grip cover 160 is fixed to the elongated handle body 150, the outer ridges 257 extend into the openings 166 and are thus exposed via the openings 166. To form openings 166, suitable injection molding equipment mates with the top surfaces of the outer ridges 257 to prevent overmolding of the outer ridges 257 and any undesired deflection of the elongated handle body 150 during the molding process. This enables the top surfaces of the outer ridges 257 to be exposed after the molding process that adds the grip cover 160 to the elongated handle body 150.

Figure 5:
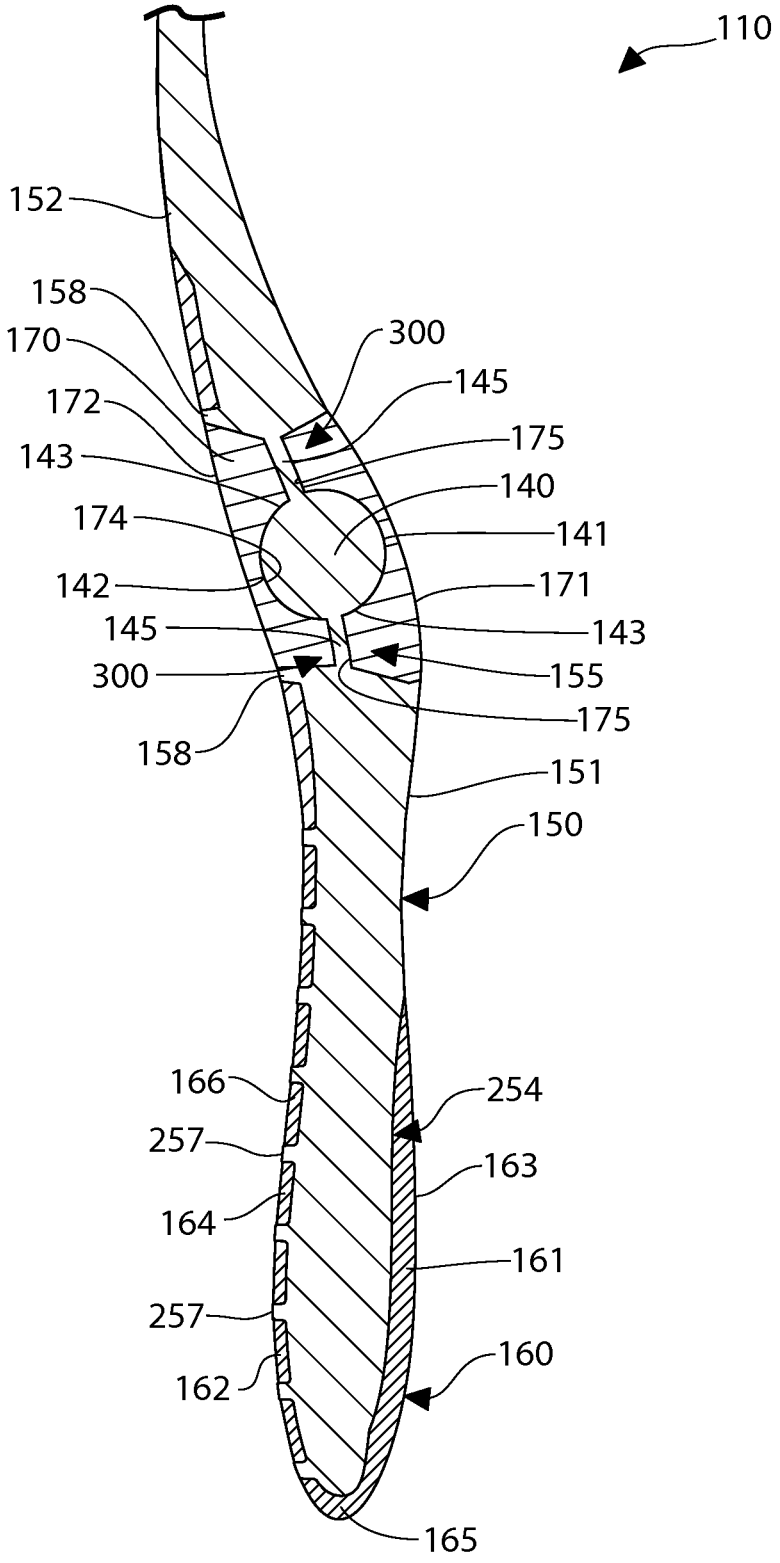
FIG. 5 is a longitudinal cross-sectional view of the toothbrush of FIG. 1 taken along view V-V of FIG. 2 according to one embodiment of the present invention.

As can be seen best in FIG. 5, the top surfaces of the outer ridges 257 are flush to the outer surface 164 of the rear leg 162 of the grip cover 160 when the handle 110 is assembled. However, in other embodiments, it may be preferable that the top surfaces of the outer ridges 257 be recessed in the openings 166 relative to the outer surface 164 of the rear leg 162 of the grip cover 160 when the handle 110 is assembled. In such an embodiment, the grip cover 160 is created to have a sufficient thickness so as to control the depth of the openings 166. By ensuring that the top surfaces of the outer ridges 257 are depressed relative to the outer surface 164 of the rear leg 162 of the grip cover 160, the openings 166 may prevent slippage of the handle 110 by enabling portions of the user's fingers to slightly protrude into the depth of the openings 166. Additionally, openings 166 channel water away from the fingers tips during wet operational conditions. Air is also able to enter the openings during brushing to provide some evaporative effect.

The grip cover 160 is preferably constructed of a resilient material, such as a thermoplastic elastomer (TPE). To provide comfort as well as control benefits, the elastomeric material of the grip cover 160 preferably has a hardness durometer measurement in the range of A13 to A50 Shore hardness, although materials outside this range may be used. A more preferred range of the hardness durometer rating is A25 to A40 Shore hardness. Furthermore, while an injection molded construction of the grip cover 160 is preferred, the grip cover 160 may, in some embodiments, be formed as a thin layer and attached to elongated handle body 150 with an appropriate adhesive, sonic welding, thermal welding or other technique.

Figure 9:
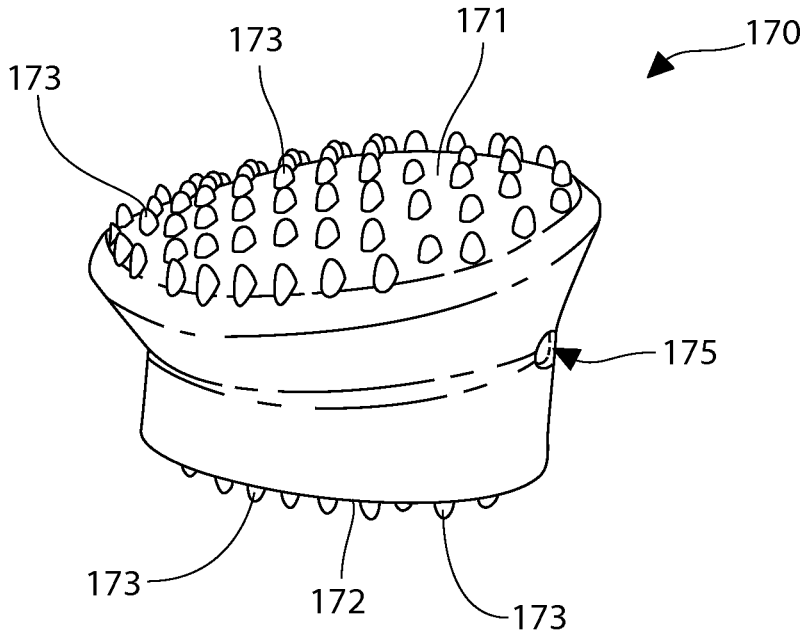
FIG. 9 is a perspective view of the grip body of the toothbrush of FIG. 1 removed from the aperture of the handle according to one embodiment of the present invention.

Referring now to FIGS. 5 and 9 concurrently, the grip body 170 is a generally bulbous shaped mass that bulges out of the aperture 155 of the elongated handle body 150. The grip body 170 fills the remaining volume of the aperture 155 of the elongated handle body 150 that is not occupied by the body 140 and the struts 145.

The grip body has a convex front surface 171 and a convex rear surface 172, which resemble an oval or elliptical shape. The bulbous shape of the grip body 170 enables the user to reliably roll and control the handle 110 between the thumb and index fingers during use. The grip body 170 may also be non-bulging or have any number of shapes, such as circular, a true oval shape and the like.

In one preferred construction, the grip body 170 has a multiplicity of finger grip protrusions 173 projecting from the front and rear surfaces 171, 172. The finger grip protrusions 173 provide a tactile feature to increase the friction on the user's finger surfaces and thus enhance the user's ability to grip the handle 110, particularly under wet conditions. The finger grip protrusions 173 are preferably provided in a desired conical or frusto-conical shape for improved grip performance. Of course, other roughened surfaces could be used.

Preferably, the grip body 170 is constructed of a different type of resilient material than that which the grip cover 160 is constructed. For example, it is preferred that the grip body 170 be constructed of a resilient material having a different hardness as compared to the hardness of the grip cover 160. The material of the grip body 170 is preferably softer than the material forming the grip cover 160. In this manner, the handle 110 may be provided with different grip features to complement the particular control need. The material of the resilient grip body 170 and the grip cover 160 are preferably each a thermoplastic elastomer.

As will be described in greater detail below, as a result of the grip body 170 being injection molded into the aperture 155 subsequent to formation and positioning of the body 140, the grip body 170 envelops the body 140 (and the struts 145 in embodiments where struts are used) when the handle 110 is assembled. Thus, conceptually, the grip body 170 comprises an internal cavity 174 that houses the body 140. The body 140 fills the entirety of the cavity 174 and, thus, is in intimate contact with the internal wall of the grip body 170 that forms the cavity 174. Similarly, two channels 175 are also formed in the grip body that provide passageways through which the struts 145 extend.

Figure 6:
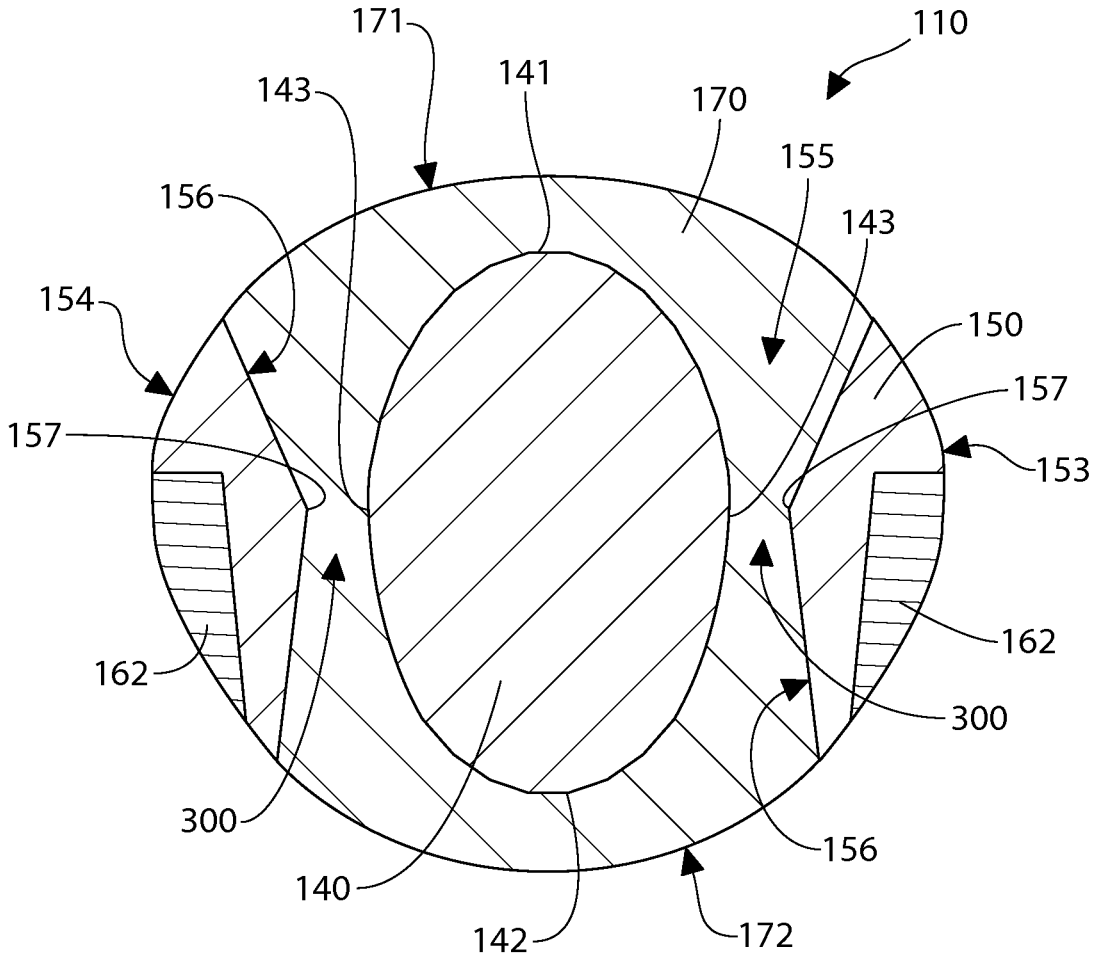
FIG. 6 is a lateral cross-sectional view of the toothbrush of FIG. 1 taken along view VI-VI of FIG. 3 according to one embodiment of the present invention.

Referring now to FIGS. 1, 5 and 6 concurrently, the structural cooperation of the of the four components 140, 150, 160, 170 of the toothbrush 100 will now be described in detail with respect to a preferred construction. In the preferred construction, the elongated handle body 150 is constructed of an opaque PP, the body 140 is constructed of the same opaque PP, the grip body 170 is constructed of a translucent (or colored) TPE having a first hardness, and the grip cover 160 is constructed of an opaque TPE having a second hardness that is greater than the first hardness.

The body 140 is disposed within the aperture 155 of the elongated handle body 150. The body 140 is supported within the aperture 155 by connection to the distal ends of the struts 145 so that the body is spaced apart from the sidewall 156 via an annular gap 300. Of course, in alternative embodiments of the invention, the body 140 may be supported within the aperture by other structures and/or assemblies. For example, the body 140 may be connected to the apex 157 of the side wall 156 in a continuous or interrupted manner.

The body 140 is suspended within the aperture 155 so that an upper-most surface portion 141 and a lower-most surface portion 142 of the body 140 is covered by the grip body 170. As a result, the entirety of the body 140 is enveloped within the grip body 170. The struts 145 are also enveloped within the grip body 170.

The upper-most surface portion 141 of the body 140 is embedded within the grip body 170 a first distance from the front surface 171 of the grip body 170. Similarly, the lower-most surface portion 142 of the body 140 is embedded within the grip body 170 a second distance from the rear surface 172 of the grip body 170. The struts 145 are embedded within the grip body 170 a third distance from both the front and rear surfaces 171, 172 of the grip body 170 (of course, the distance between the struts 145 and front surface 171 and the distance between the struts 145 and rear surface 172 may be different from one another). The first and second distances and the degree of translucency of the grip body 140 are selected so that the upper-most surface portion 141 and the lower-most surface portion 142 of the body 140 are visible to the user through the grip body 170 itself (as illustrated in FIGS. 1-4). However, it is preferred that the third distance and the degree of translucency of the grip body 140 are selected so that the struts 145 are not visible to the user through the grip body 170 itself. As a result, the body 140 appears to float within the grip body 170 in an unsupported and/or suspended manner. Of course, in other embodiments of the invention, it may be desirable that the struts 145 (or other supporting structure) be at least partially visible through the grip body 170 by selecting a transparent and/or less translucent material for the grip body 170 and/or locating the struts 145 closer to the surfaces 171, 172. Moreover, in further alternative embodiments, the body 140 may be actually suspended within the grip body 170 by omitting the struts 145 (or other supporting structures).

As mentioned above, it is preferred that the struts 145 be structures that are thin relative to the body 140. Preferably, the body 140 has a maximum lateral cross-sectional area (illustrated in FIG. 6) and the struts 145 have a maximum lateral cross-sectional area that is between 1 to 50% of the lateral maximum cross-sectional area of the body 140. More preferably, the struts 145 have a maximum lateral cross-sectional area that is between 1 to 20% of the lateral maximum cross-sectional area of the body 140. Most preferably, the struts 145 have a maximum lateral cross-sectional area that is between 1 to 10% of the lateral maximum cross-sectional area of the body 140.

In the illustrated embodiment, the struts 145 are cylindrical elongated beam structures that have a substantially constant circular transverse cross-sectional area. The invention, however, is not so limited and the struts 145 may take on other cross-sectional shapes and/or may have varied cross-sectional sizes and/or shapes.

The thin nature of the struts 145 allows the body 140 to move and/or shift within the grip body 170 when subjected to normal forces imparted to the handle 110 during an oral care session. The struts 145 then act to return the body 140 to its original position once the user stops applying force. As a result, from a utilitarian standpoint, the body 140 acts as a shifting mass centroid of the grip body 170 during an oral care session. This prohibits excessive force from being applied to the user's oral surface via force applied to the handle 110.

In addition to a utilitarian function, the body 140 can provide a mechanism by which the handle 110 of the toothbrush 100 can provide aesthetic appeal. For example, the body 140 can comprise and/or be shaped into an ornamental feature. Examples of such ornamental features include the body 140 comprising and/or being formed into the shape of a character, a design, a jewel, a logo, an animal, a flower, a plant, or a decoration. Of course, other aesthetically pleasing decorative features can be implemented.

As mentioned above, the grip body 170 is disposed within and fills the remaining volume of the aperture 155 of the elongated handle body 150 that is not occupied by the body 140 and the struts 145. The convex front and rear surfaces 171, 172 of the grip body 170 bulge from the aperture 155 and form a portion of the front and rear surfaces 111, 112 of the overall handle 110. The grip body 170 is preferably formed in the aperture 155 via a one or two shot injection molding technique. The tapered shape of the sidewalls 156 of the aperture help retain the grip body 170 within the aperture over the life cycle of the toothbrush 100. Additionally, a chemical bond may be formed between the TPE of the grip body 170 and the PP of the elongated handle body 150 (and body 140) during the injection molding process.

The grip cover 160 is applied to the outer surface of the elongated handle body 150. More specifically, the grip cover 160 is fixed to the elongated handle body 150 so that: (1) the front leg 161 of the grip cover 160 nests within the portion of the channel 254 on the front surface 151 of the elongated handle body 150; (2) the curved portion 165 of the grip cover 160 nests within the portion of the channel 254 that wraps around the proximal end 255 of the elongated handle body 150; and (3) the rear leg 162 of the grip cover 160 nests within the portion of the channel 254 on the rear surface 152 of the elongated handle body 150.

The outer ridges 257 of the elongated handle body 150 extend into the openings 166 of the grip cover 160 and preferably remain depressed below the rear surface 164 of the rear leg 162 of the grip cover 160 as discussed above. The grip cover 160 fills the channel 254, thereby wrapping around the proximal end 155 of the elongated handle body 150 and surrounding the aperture 155 on the rear surface 152 of the elongated handle body 150. The grip cover 160 also fills the transverse channels/slots between the outer ridges 257 of the elongated handle body 150.

The grip body 160 is fixed to the elongated handle body 150 by a chemical bond that is formed between the TPE of the grip cover 160 and the PP of the elongated handle body 150 during the injection molding process. Finally, while grip cover 160 is shown as a single unitary member or layer, it could be formed by separate independent parts or sections in certain embodiments.

The inventive aspects discussed above may be practiced for a manual toothbrush, a powered toothbrush or any implement that includes a handle. In operation, the previously described features, individually and/or in any combination, improve the control, grip performance, aesthetics and cost point of oral implements. Other constructions of toothbrush are possible. For example, the head 120 may be replaceable or interchangeable on the handle 110. The head 120 may include various oral surface engaging elements, such as inter-proximal picks, brushes, flossing element, plaque scraper, tongue cleansers and soft tissue massages. While the various features of the toothbrush 100 work together to achieve the advantages previously described, it is recognized that individual features and sub-combinations of these features can be used to obtain some of the aforementioned advantages without the necessity to adopt all of these features in an oral care implement.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:
- a handle having a longitudinal axis, a first surface, and a second surface opposite the first surface;
- a head connected to the handle;
- an aperture forming a passageway through the handle from the first surface to the second surface;
- a bulbous body positioned within the aperture;
- at least one strut extending from a sidewall of the aperture, the bulbous body connected to a distal end of the strut so that the bulbous body is supported within the aperture so as to be spaced from the sidewall of the aperture by a gap; and
- an elastomeric grip body disposed within the aperture and enveloping the bulbous body and the at least one strut;
- wherein the bulbous body has an upper-most surface portion and a lower-most surface portion, wherein the upper-most and lower-most surface portions are covered by the elastomeric grip body, and wherein the at least one strut is substantially coaxial with the longitudinal axis of the handle.

2. The oral care implement of claim 1 further comprising a plurality of the struts.

3. The oral care implement of claim 2 comprising a first strut and a second strut, the first and second struts extending from opposing surfaces of the sidewall of the aperture.

4. The oral care implement of claim 3 wherein the bulbous body has a maximum lateral cross-sectional area and the strut has a maximum lateral cross-sectional area, wherein the maximum lateral cross-sectional area of the strut is between 1 to 50% of the maximum lateral cross-sectional area of the bulbous body.

5. The oral care implement of claim 4 wherein the maximum lateral cross-sectional area of the strut is between 1 to 20% of the maximum lateral cross-sectional area of the bulbous body.

6. The oral care implement of claim 5 wherein the maximum lateral cross-sectional area of the strut is between 1 to 10% of the maximum lateral cross-sectional area of the bulbous body.

7. The oral care implement of claim 1 wherein the bulbous body is visible through the elastomeric grip body and the at least one strut is not visible through the elastomeric grip body.

8. The oral care implement of claim 1 wherein the bulbous body is constructed of a hard material.

9. The oral care implement of claim 1 further comprising a plurality of teeth cleaning elements extending from the head.

10. The oral care implement of claim 1 wherein the bulbous body, the at least one strut and the sidewall are formed as a unitary structure via injection molding.

11. The oral care implement of claim 1 wherein the bulbous body, the at least one strut, and the sidewall a constructed of a hard plastic; and wherein the bulbous body is visible through the elastomeric grip body and the at least one strut is not visible through the elastomeric grip body.

12. The oral care implement of claim 11 wherein the elastomeric grip body is formed of a translucent elastomer.

13. The oral care implement of claim 1 wherein the bulbous body comprises an ornamental feature.

14. The oral care implement of claim 13 wherein the ornamental feature comprises one of a character, a design, a logo, an animal, a flower, a plant, or a decoration.

15. The oral care implement of claim 1 wherein the aperture comprises a maximum lateral cross-sectional area, and wherein the maximum lateral cross-sectional area of the aperture occupies greater than 50% of a lateral cross-sectional area of the handle at that point.

16. The oral care implement of claim 1 further comprising an elastomeric grip cover covering at least a portion of the handle.

17. The oral care implement of claim 1 further comprising:

a first strut and a second strut, the first and second struts extending from opposing surfaces of the sidewall of the aperture;

wherein the bulbous body has a maximum lateral cross-sectional area and the first and second struts each have a maximum lateral cross-sectional area, wherein the maximum lateral cross-sectional area of the first and second struts is between 1 to 20% of the maximum lateral cross-sectional area of the bulbous body;

wherein the first and second struts are substantially coaxial with the longitudinal axis of the handle and the elastomeric grip body envelopes the first and second struts;

wherein the bulbous body is visible through the elastomeric grip body and the first and second struts are not visible through the elastomeric grip body;

a plurality of teeth cleaning elements extending from the head;

wherein the bulbous body, the first and second struts, and the sidewall are formed of a hard plastic during an injection molding process;

wherein the elastomeric grip body is formed of a translucent thermoplastic elastomer; and wherein the aperture comprises a maximum lateral cross-sectional area, and wherein the maximum lateral cross-sectional area of the aperture occupies greater than 50% of a lateral cross-sectional area of the handle at that point.

18. An oral care implement comprising:

a handle having a longitudinal axis, a first surface, and a second surface opposite the first surface;

a head connected to the handle;

an aperture forming a passageway through the handle from the first surface to the second surface;

a body positioned within the aperture, the body constructed of an opaque hard plastic and supported within the aperture so as to be spaced from a sidewall of the aperture;

an elastomeric grip body constructed of a translucent thermoplastic elastomer disposed within the aperture and enveloping the body; and wherein the body is visible through the elastomeric grip body.

19. The oral care implement of claim 18 further comprising at least one strut extending from the sidewall of the aperture, the body connected to a distal end of the at least one strut.

20. The oral care implement of 19 wherein the at least one strut is not visible through the elastomeric grip body.

21. The oral care implement of claim 19 wherein the body has a maximum lateral cross-sectional area and the at least one strut has a maximum lateral cross-sectional area, wherein the maximum lateral cross-sectional area of the at least one strut is between 1 to 20% of the maximum lateral cross-sectional area of the body.

22. The oral care implement of claim 18 further comprising:

a first strut and a second strut, the first and second struts extending from opposing surfaces of the sidewall of the aperture;

wherein the body has a maximum lateral cross-sectional area and the first and second struts each have a maximum lateral cross-sectional area, wherein the maximum lateral cross-sectional area of the first and second struts is between 1 to 20% of the maximum lateral cross-sectional area of the body;

wherein the first and second struts are substantially coaxial with the longitudinal axis of the handle;

wherein the elastomeric grip body envelopes the first and second struts;

wherein the first and second struts are not visible through the elastomeric grip body;

wherein the body has an upper-most surface portion and a lower-most surface portion, wherein the upper-most and lower-most surface portions are covered by the elastomeric grip body, and wherein the first and second struts are substantially coaxial with the longitudinal axis of the handle;

a plurality of teeth cleaning elements extending from the head;

wherein the body, the first and second struts, and the sidewall are integrally formed via an injection molding process; and wherein the aperture comprises a maximum lateral cross-sectional area, and wherein the maximum lateral cross-sectional area of the aperture occupies greater than 50% of a lateral cross-sectional area of the handle at that point.

23. An oral care implement comprising:

a handle having a longitudinal axis, a first surface and a second surface opposite the first surface;

a head connected to the handle;

an aperture forming a passageway through the handle from the first surface to the second surface; and an elastomeric grip body disposed within the aperture and enveloping a solid body;

wherein the solid body is constructed of a hard material and the elastomeric grip body is constructed of a thermoplastic elastomer, the solid body is visible through the elastomeric grip body and appears to be floating within the elastomeric grip body, and the solid body is supported in a spaced-apart manner from a sidewall of the aperture by at least one strut.

24. The oral care implement of claim 23 wherein an annular gap exists between the solid body and the sidewall.

25. The oral care implement of claim 23 wherein the solid body is constructed of an opaque hard plastic and the elastomeric grip body is constructed of a translucent thermoplastic elastomer.

26. An oral care implement comprising:

a handle;

a head connected to the handle;

an aperture in the handle; and a grip body disposed within the aperture and enveloping a body, the grip body constructed of a translucent first material and the body constructed of an opaque second material, the second material being harder than the first material, wherein the body is supported in a spaced-apart manner from a sidewall of the aperture by at least one strut, the body has a maximum lateral cross-sectional area and the at least one strut has a maximum lateral cross-sectional area, wherein the maximum lateral cross-sectional area of the at least one strut is 1 to 20% of the maximum lateral cross-sectional area of the body.

27. The oral care implement of claim 26 wherein the first material is a thermoplastic elastomer and the second material is a hard plastic.

28. The oral care implement of claim 26 wherein the aperture extends through the handle between opposing surfaces of the handle.

29. The oral care implement of claim 26 wherein the body is visible through the grip body and appears to be floating within the grip body.

* * * * *